United States Patent [19]

Santiago, Sr.

[11] 4,150,602

[45] Apr. 24, 1979

[54] MUSICAL INSTRUMENT

[76] Inventor: Juan I. Santiago, Sr., 15 E. 3rd St., Lansdale, Pa. 19446

[21] Appl. No.: 762,116

[22] Filed: Jan. 24, 1977

[51] Int. Cl.[2] ..... G10D 13/06

[52] U.S. Cl. ..... 84/402; 46/191

[58] Field of Search ..... 46/177, 191, 193; 84/402, 403, 418

[56] References Cited

U.S. PATENT DOCUMENTS

| | | | |
|---|---|---|---|
| 1,567,803 | 12/1925 | Ludwig | 84/402 X |
| 2,678,517 | 5/1954 | Gibson | 84/418 X |
| 3,566,737 | 3/1971 | Gussak | 84/402 |

FOREIGN PATENT DOCUMENTS

| | | | |
|---|---|---|---|
| 20973 of | 1890 | United Kingdom | 84/418 |

*Primary Examiner*—Lawrence R. Franklin

[57] ABSTRACT

A board with a handle, has several distinct rows of holes in it, each row having a plurality of holes which are separated by hubs which extend into the passageway between the holes from opposite sides, and a pair of jingle discs between each pair of hubs.

1 Claim, 7 Drawing Figures

MUSICAL INSTRUMENT

This invention relates to musical instruments and particularly to a percussion type instrument which will emit a pronounced musical jingling sound. Instruments which will make such a jingle are now available and they are commonly used in playing music of a Spanish character. One such instrument is the tambourine but it has the drawback of not making a very loud sound. The tambourine has the additional disadvantage of being fairly complicated in its structure and therefore being objectionably expensive.

The present invention provides a hand held instrument which, when it is rapidly shaken or is sharply struck, will produce an exceptionally loud jingle. As long as this agitation or percussion of the instrument is continued this pleasant audible sound will be made. The loud sound which is produced is due to the novel arrangement or location in the percussion instrument of an exceptionally large number of the jingle discs which make the musical note.

Whereas the conventional tambourine may hold only a half dozen or so of the jingle discs, the present instrument can hold up to 18 or even more of the metal discs. Their combined vibration under the impact of being shaken or struck results in a very loud jingle. The ordinary tambourine cannot hold such a large multiplicity of the discs. Moreover, even with this large number of discs the present instrument has an attractive appearance.

The instrument is simple in its construction and it is easily fabricated despite the large number of the jingle discs which are held by it. The metallic jingle discs themselves may be of usual size and shape and can therefore be cheaply obtained. The body of the instrument can be made of low cost material and can be formed with tools of the most common type. Or it can be molded to shape.

Figure 1:
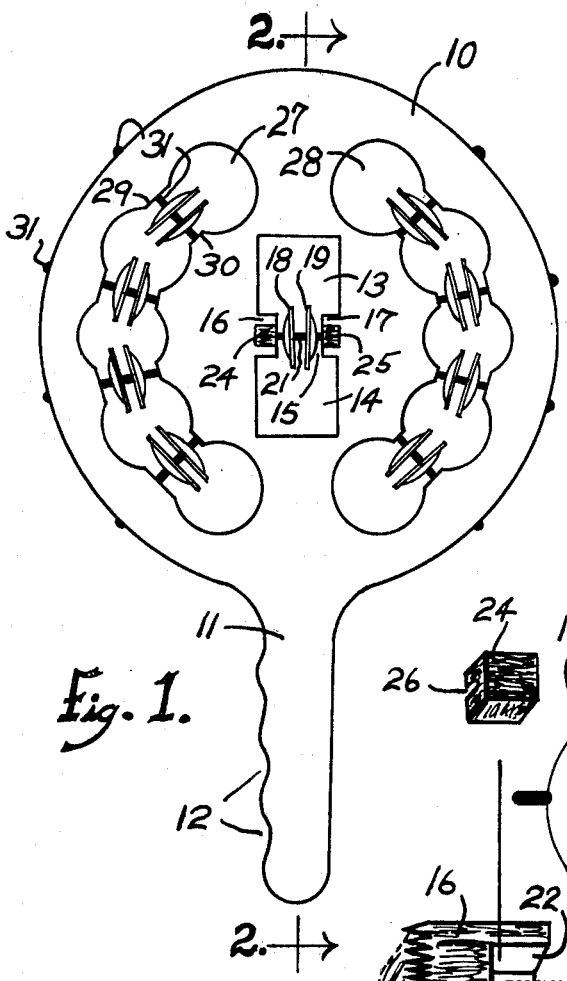
Figure 2:
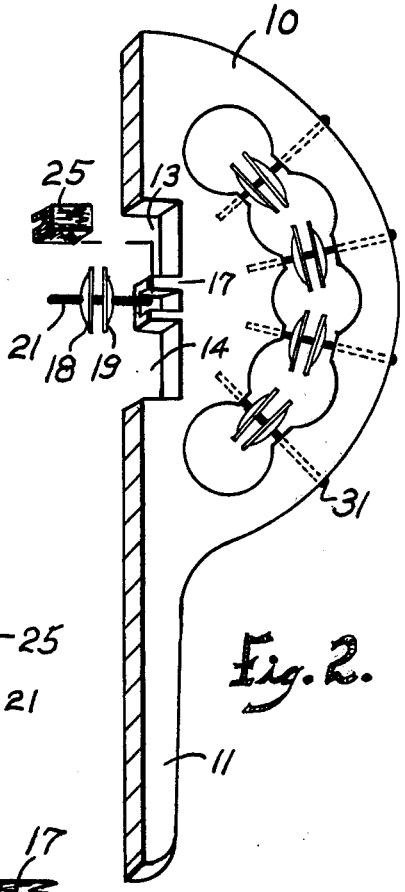
Figure 3:
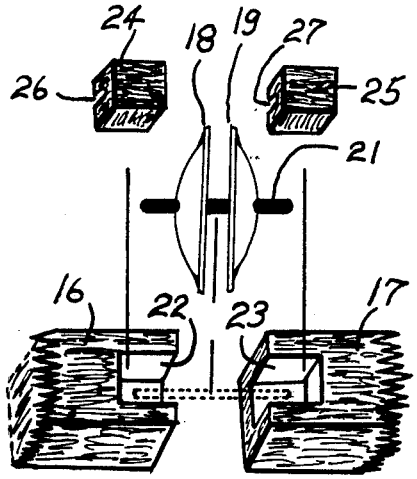
Figure 4:
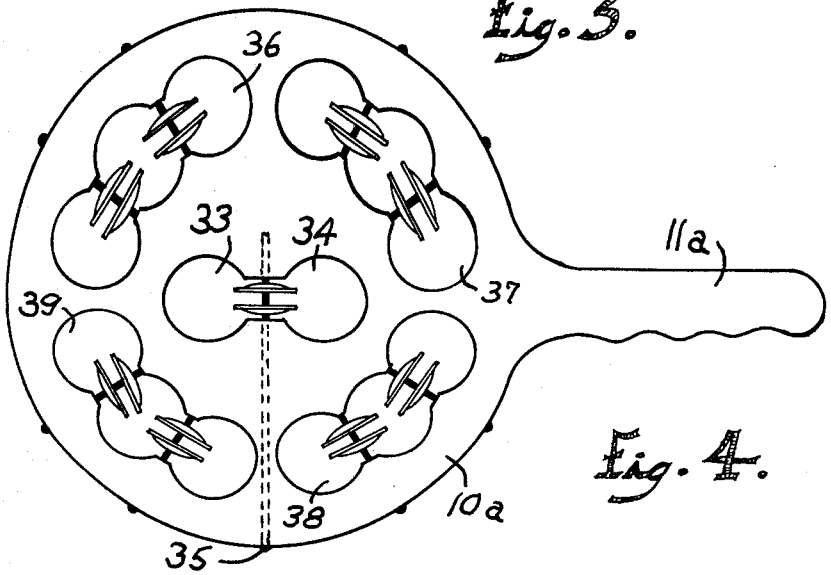
Figure 5:
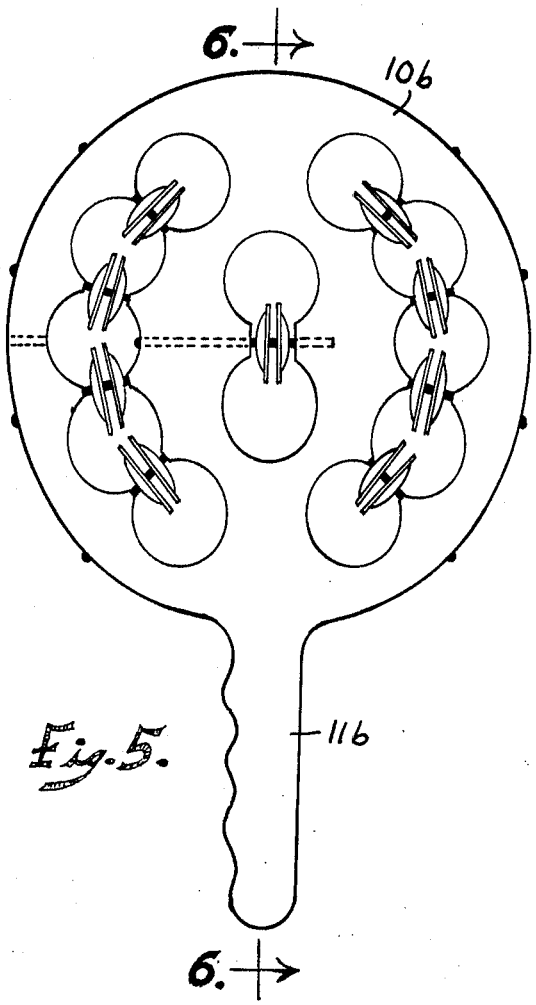
Figure 6:
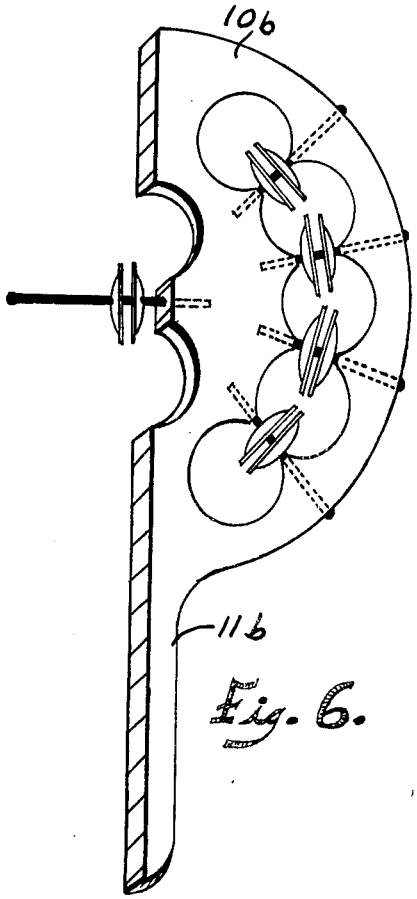
Figure 7:
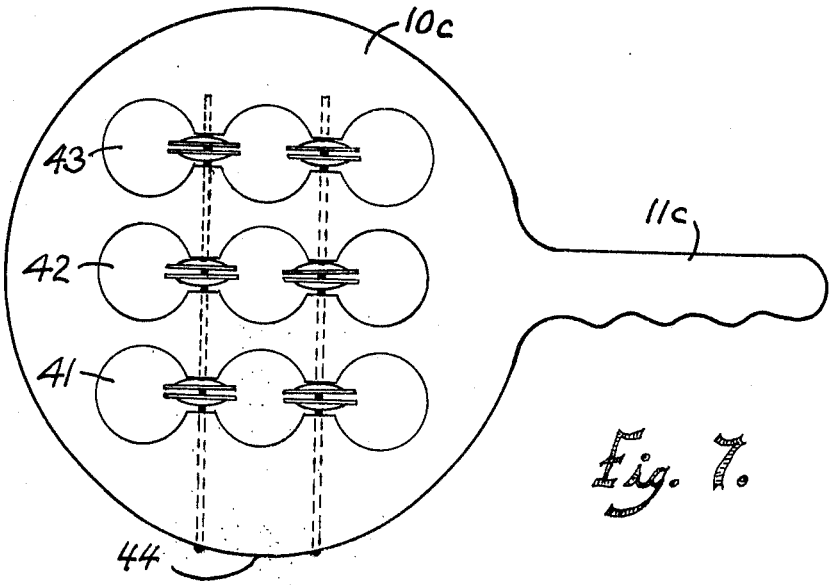

Representative examples of the invention are illistrated in the accompanying drawings in which:

FIG. 1 is an elevational or face view of a preferred embodiment of the invention, FIG. 2 is a perspective, sectional view on the line 2—2 of FIG. 1, FIG. 3 is an exploded, perspective view on an enlarged scale of the center of FIG. 1, FIG. 4 is a face view of a modification of the structure, FIG. 5 is a face view of another modification of the structure, FIG. 6 is a perspective, sectional view on the line 6—6 of FIG. 5, and FIG. 7 is an elevational or face view of still another structural modification.

Referring first to FIGS. 1, 2 and 3, the frame which holds the jingle discs is made up of a body 10 and a handle 11. The body 10 is shown as a circle in outline so that it will not have any sharp corners but it may as well be oval, rectangular, or of any other peripheral shape. The handle 11 is shown as being integral with the body to provide a strong, or rigid structure but it can be a separate piece which is attached to the body 10 by any suitable fastening means. The handle preferably, but not necessarily, has finger recesses 12 along one edge to provide a better fit in the hand and enable a firmer hold.

The body 10 is preferably made of solid wood or plywood but it made be made of a firm plastic or of a pressed wood board. If it is made of plastic it may be molded or cast to shape to make a less expensive instrument. The body material may be from about ¼ inch to about ½ inch thick and preferably ⅜ inch. The diameter of the body 10 is preferably from 9 to 10 inches but it may be up to several inches smaller or larger. A small size restricts the number of jingle discs which may be held in the frame and too large a size makes it awkward to shake.

At the center of the body 10 are two holes 13 and 14 which are connected by a narrow passageway or channel 15 which extends between the holes. The passageway is centered along the line which joins the centers of the two holes so that a symetrical conformation results. The passageway 15 is narrow enough relative to the holes 13 and 14 so that hubs or bosses 16 and 17 are formed between the holes. Or, stated differently, the hubs 16 and 17 project into the passageway between the holes 13 and 14.

The holes 13 and 14 are here shown as square but as will become apparent herein they may have other shapes. Also, it should be noted that the centers of the holes are substantially on the extension of a line which lies lengthwise through the center of the handle 11. The jingle discs 18 and 19 are disposed in the channel 15 as will now be described.

The discs 18 and 19 are mounted on a pin 21 which passes through holes at the center of the discs and this should be a very loose fit so that the discs can freely move and turn on the pin. It is this freedom of movement and the ease with which the rims of the discs can strike together that produces the characteristic jingle sound. The discs may be the conventional ones which can readily be purchased commercially. Generally, they are bowed at the center as is shown.

To support the pin 21, grooves or notches 22 and 23 are formed in the hubs 16 and 17 and these grooves are in line with each other. They are about half as deep as the thickness of the body 10. Retaining blocks 24 and 25 fit in the grooves 22 and 23 to hold the cross pin 21 at the bottoms thereof. To more accurately align the pin 21 the blocks 24 and 25 may be formed with slots 26 and 27 which closely receive the pin 21. The blocks 24 and 25 are held in place in the grooves 23 and 24 by glue or small brads or by other fastening means. The pin 21 is preferably of metal such as a portion of a nail but it may be of a strong plastic.

The discs 18 and 19 occupy considerably less space than the width of the passageway 15, or, the distance between the hubs 16 and 17. This lets the discs move back and forth along the pin 21 and strike each other and produce the musical sound. The discs may be reversed on the pin so that their bowed centers are toward each other. Instead of the blocks 24 and 25 the grooves 22 and 23 may be filled with so-called plastic-wood.

To attach more discs to the instrument and thereby produce a louder jingle sound a series or row of holes are formed in the space between the center holes and the periphery of the body 10. One row of holes is shown at 27 and another row of holes is shown at 28. Each hole is round and their centers are in the arc of a circle which has its center at the axis of the body 10. The centers of the holes are slightly further apart than the diameter of the holes so that the passageway between the adjacent holes will form the hubs 29 and 30.

Each row 27 or 28 could have only two holes in it and up to six holes or as many more as the space and size of the body will permit. If it were not for the hubs between the adjacent holes, i.e., if the passageway were as wide as the hole diameter, the discs could move so far apart the they would not strike against each other as often as they are required to do because of the narrow channel. By having the holes larger than width of the passageway there is no muffling effect on the jingling of the discs.

To hold the discs in place between the hubs 29 and 30, nails 31 or like pins are forced inwardly from the outer edge of the body and across the passageway between the hubs. It may be simpler to predrill holes where the nails are to be inserted.

FIG. 4 is a modification to show that the center holes 33 and 34 may be round instead of square, and they may as well be oval or oblong. The figure shows that a long nail 35 which enters from the edge may hold the center discs in place. Also, the figure shows that there may be four sets or rows 36, 37, 38 and 39, of holes, each row having three holes in it. If the body **10*a* were large enough each of the four rows could have four or more holes in it. The handle 11*a* shows the similarity to handle 11**.

FIGS. 5 and 6 show a combination of details of the preceding figures. The body **10*b* and handle 11*b* are similar to 10 and 11. The center holes are round as in FIG. 4 and there are two rows of five holes each as in FIGS. 1 and 2**.

FIG. 7 shows a different arrangement of the rows of holes as there are three straight rows each having three holes in it. These straight rows 41, 42 and 43 in the body **10*c* are parallel to each other and to a longitudinal axis through the handle 11*c***. Depending on the size of the holes and the size of the body, more or fewer rows or holes in each row, may be made.

In all the examples of the invention the body is preferably a flat board or plate but it can be slightly dished to give it a unique appearance. The loudest jingles will seem to come from the discs which are mostly parallel to the axis of the handle as they will ordinarily get the greatest agitation. For instance, if the instrument of FIG. 7 is grasped by the handle and the edge area indicated at 44 is struck at the other hand or on the body a very loud combined jingle will be emitted by the discs.

I claim:

1. A musical instrument comprising a body portion and an attached handle portion, said body portion being a flat plate having a plurality of rows of holes therein and each row having a plurality of holes making up the separate rows, the holes in each row being connected together by passageways of lesser width than the size of the holes so that hubs are formed on each side of the passageway, a pair of jingle discs disposed between each pair of hubs, and a retaining pin passing through each pair of discs and supported by the adjacent hubs.

* * * * *